US010493648B2

(12) United States Patent
Nakatsu

(10) Patent No.: US 10,493,648 B2
(45) Date of Patent: Dec. 3, 2019

(54) CUTTING DEVICE AND PRINTING APPARATUS

(71) Applicant: SEIKO EPSON CORPORATION, Tokyo (JP)

(72) Inventor: Masashi Nakatsu, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 20 days.

(21) Appl. No.: 15/958,761

(22) Filed: Apr. 20, 2018

(65) Prior Publication Data

US 2018/0304486 A1 Oct. 25, 2018

(30) Foreign Application Priority Data

Apr. 21, 2017 (JP) ..... 2017-084207

(51) Int. Cl.
*B65H 35/00* (2006.01)
*B26D 1/18* (2006.01)
(Continued)

(52) U.S. Cl.
CPC ..... *B26D 7/0006* (2013.01); *B26D 1/185* (2013.01); *B26D 1/205* (2013.01); *B26D 5/02* (2013.01); *B26D 5/06* (2013.01); *B26D 5/16* (2013.01); *B41J 11/06* (2013.01); *B41J 11/70* (2013.01); *B41J 11/706* (2013.01); *B41J 15/06* (2013.01);
(Continued)

(58) Field of Classification Search
CPC ..... B26D 7/0006; B26D 5/02; B26D 5/16; B26D 5/06; B26D 1/185; B26D 1/205; B26D 2210/11; B26D 2007/005; B41J 11/706; B41J 11/70; B41J 11/06; B41J 15/06; B41J 2/06; B41J 2/14016; B41J 2/14201; B65H 35/0086
See application file for complete search history.

(56) References Cited

U.S. PATENT DOCUMENTS 5,146,827 A 9/1992 Komatsu et al.
6,315,474 B1 * 11/2001 Giles ..... B26D 1/0006 346/24
8,657,402 B2 * 2/2014 Maeyama ..... B26D 1/045 347/104

FOREIGN PATENT DOCUMENTS

EP 0 196 580 A2 10/1986
EP 0 631 877 A2 6/1994
(Continued)

OTHER PUBLICATIONS

Extended European Search Report dated Sep. 28, 2018 in related European Appl. 18168240.2 (6 pgs.).

*Primary Examiner* — Bradley W Thies
*Assistant Examiner* — Michael T Konczal
(74) *Attorney, Agent, or Firm* — Foley & Lardner LLP

(57) ABSTRACT

A cutting portion (cutting device) includes a fixed blade that extends in an intersecting direction (X axis direction) intersected with a transport direction transporting a roll paper, and a round blade that cuts the roll paper by relatively moving in the intersecting direction (X axis direction) with respect to the fixed blade in a state of being abutted on the fixed blade, in which the fixed blade extends over a portion of a range where the round blade relatively moves, and the round blade is in a separation state of being separated from the fixed blade in the transport direction when entering a region facing the fixed blade (cutting operation region) from a region not facing the fixed blade (standby region).

6 Claims, 6 Drawing Sheets

(51) Int. Cl.

| | |
|---|---|
| ***B26D 7/00*** | (2006.01) |
| ***B26D 1/20*** | (2006.01) |
| ***B26D 5/06*** | (2006.01) |
| ***B65H 20/02*** | (2006.01) |
| ***B41J 11/70*** | (2006.01) |
| ***B41J 15/06*** | (2006.01) |
| ***B41J 11/06*** | (2006.01) |
| ***B26D 5/02*** | (2006.01) |
| ***B26D 5/16*** | (2006.01) |
| *B41J 2/06* | (2006.01) |
| *B41J 2/14* | (2006.01) |

(52) U.S. Cl.

CPC ..... *B65H 20/02* (2013.01); *B65H 35/0086* (2013.01); *B26D 2007/005* (2013.01); *B26D 2210/11* (2013.01); *B41J 2/06* (2013.01); *B41J 2/14016* (2013.01); *B41J 2/14201* (2013.01)

(56) References Cited

FOREIGN PATENT DOCUMENTS

| | | | | |
|---|---|---|---|---|
| EP | 0631877 | A2 * | 1/1995 | ..... B41J 11/005 |
| JP | 03-050452 | U | 5/1991 | |
| JP | 04-135197 | A | 5/1992 | |
| JP | 04-152096 | A | 5/1992 | |
| JP | 11-099716 | A | 4/1999 | |
| JP | 2005-349676 | A | 12/2005 | |

* cited by examiner

CUTTING DEVICE AND PRINTING APPARATUS

BACKGROUND

1. Technical Field

The present invention relates to a cutting device and a printing apparatus including the cutting device.

2. Related Art

As a printing apparatus (printer), there is known an apparatus provided with a cutting device capable of cutting a printing paper at an appropriate position according to a printed image.

In addition, as a cutting device that cuts a sheet-like material such as printing paper, for example, there is known a device provided with a round blade rotatably driven and a disk blade rotatably journaled as a sheet material cutting device described in JP-A-4-152096. This sheet material cutting device is provided with a moving device of the disk blade which press-contacts and separates the round blade and the disk blade mutually, and a pressure contact force is applied via an elastic body, so that fine adjustment is unnecessary and the sheet material can be stably cut.

Meanwhile, as a cutting device used in a printing apparatus, there is a device in which one of the blades is a movable blade, the other blade is a fixed blade extending in a cutting operation region, and the movable blade stands by at a standby position in the main body of the printing apparatus to separate the movable blade from the fixed blade in a non-cutting operation, while the movable blade abuts on the fixed blade so as to cut in cooperation while sliding contact with each other in a cutting operation.

In such a configuration, in a case where the movable blade moves from the standby position to the cutting operation region where the cutting operation is performed, since the movable blade is biased toward the fixed blade side, there is a possibility that the movable blade vigorously contacts (collides) with an edge end of the fixed blade when abutting on the fixed blade. This is a cause of applying excessive load, impact, or damage to the movable blade.

In the sheet material cutting device described in JP-A-4-152096, although the moving device that press-contacts and separates the round blade and the disk blade is provided, it is not a configuration in which the movable blade moves and abuts on the cutting operation region having the fixed blade, and it is not taken into consideration of excessive load, impact, or damage applied to such a movable blade. Therefore, even if the moving device as described in JP-A-4-152096 is cited and applied, it is impossible to realize a method for solving the excessive load, impact, or damage when the movable blade moves to the cutting region and abuts on the fixed blade.

SUMMARY

The invention can be realized in the following application examples or aspects.

Application Example 1

According to this application example, there is provided a cutting device including a first cutting member that extends in an intersecting direction intersected with a transport direction transporting a medium, and a second cutting member that cuts the medium by relatively moving in the intersecting direction with respect to the first cutting member in a state of being abutted on the first cutting member, in which the first cutting member extends over a portion of a range where the second cutting member relatively moves, and the second cutting member is in a separation state of being separated from the first cutting member in the transport direction when entering a region facing the first cutting member from a region not facing the first cutting member.

In this configuration, at the time of movement of the second cutting member, when entering the region facing the first cutting member from the region not facing the first cutting member, the second cutting member is in the separation state of being separated from the first cutting member in the transport direction. That is, when the second cutting member moves to the region facing the first cutting member, the second cutting member is prevented from colliding with an edge end portion of the first cutting member. As a result, abrasion and damage of the first cutting member and the second cutting member can be suppressed.

Application Example 2

In the cutting device according to the above application example, the cutting device further includes a support portion that supports the second cutting member, and a guide portion that guides the second cutting member in accordance with a movement from the region not facing the first cutting member to the region facing the first cutting member, in which the second cutting member is changed from the separation state to an abutting state of abutting on the first cutting member by sliding contact between the guide portion and the support portion when the second cutting member moves in the intersecting direction.

In this configuration, when the second cutting member moves in the intersecting direction, the second cutting member changes from the separation state to the abutting state of abutting on the first cutting member by sliding contact between the guide portion and the support portion. A change from the separation state of the second cutting member to the abutting state is guided by the guide portion, so that a collision when the second cutting member abuts on the first cutting member can be more reliably avoided.

Application Example 3

In the cutting device according to the above application example, the second cutting member is a disk-shaped round blade rotatably supported.

In this configuration, the second cutting member that cuts the medium by relatively moving in the intersecting direction with respect to the first cutting member is a disk-shaped round blade rotatably supported and cutting while rotating. Therefore, a scissors angle does not change unlike a push cutting type cutting device, and sharpness (cutting condition) hardly fluctuates with the movement of the second cutting member, so that cutting can be more stably performed.

In addition, in such a configuration, in a case of constructing the cutting device more compactly, although the length of an outer circumference of the round blade is shorter than an extension length of the first cutting member, and the life of the round blade tends to be shorter than the life of the first cutting member. According to the cutting device of this application example, an impact (impact such as collision of the round blade against the first cutting member) can be alleviated when the round blade (second cutting member) moves and abuts on the first cutting member, so that the life of the round blade (second cutting member) can be further elongated.

Application Example 4

According to this application example, there is provided a printing apparatus including a transport portion that transports a medium in a transport direction, a printing portion that performs printing on the medium to be transported, a platen that supports the medium in a printing region where the printing is performed, a first cutting member that extends in an intersecting direction intersected with the transport direction, and a second cutting member that cuts the medium by relatively moving in the intersecting direction with respect to the first cutting member in a state of being abutted on the first cutting member, in which the first cutting member extends over a portion of a range where the second cutting member relatively moves, and the second cutting member is in a separation state of being separated from the first cutting member in the transport direction when entering a region facing the first cutting member from a region not facing the first cutting member.

In this configuration, at the time of movement of the second cutting member, when entering the region facing the first cutting member from the region not facing the first cutting member, the second cutting member is in the separation state of being separated from the first cutting member in the transport direction. That is, when the second cutting member moves to the region facing the first cutting member, the second cutting member is prevented from colliding with an edge end portion of the first cutting member. As a result, a frequency with which the second cutting member is damaged is further reduced. Furthermore, since the impact on the medium and the printing portion due to the movement of the second cutting member is alleviated, a possibility that the medium is displaced from a desired position by the impact, or a possibility that a meniscus of the ejection head is destroyed even in a case where an ink jet head is used as an ejection head constituting the printing portion, is reduced. Therefore, the printing apparatus can be more stably operated.

Application Example 5

In the printing apparatus according to the above application example, the printing apparatus further includes a platen unit that includes the first cutting member or the second cutting member and the platen, in which the platen unit is movable to a first position where the platen faces the printing portion and a second position where the platen is more separated from the printing portion than in the first position.

In this configuration, the platen unit that includes the first cutting member or the second cutting member and the platen, is movable to the first position where the platen faces the printing portion and the second position where the platen is more separated from the printing portion than in the first position. That is, since the first cutting member (or second cutting member) and the platen can be separated from the printing portion, it is possible to more easily perform maintenance work such as a case where the medium is clogged (paper jam) in the printing region.

Application Example 6

In the printing apparatus according to the above application example, the printing portion further includes an ejection head that moves to a home position deviated from the printing region, and a region where the second cutting member does not face the first cutting member is provided on the same side as the home position in the intersecting direction.

In this configuration, in the intersecting direction, the home position where the ejection head moves and the region where the second cutting member does not face the first cutting member (for example, region where the second cutting member stands by) are provided on the same side as each other, and thus the printing apparatus can be configured more compactly.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
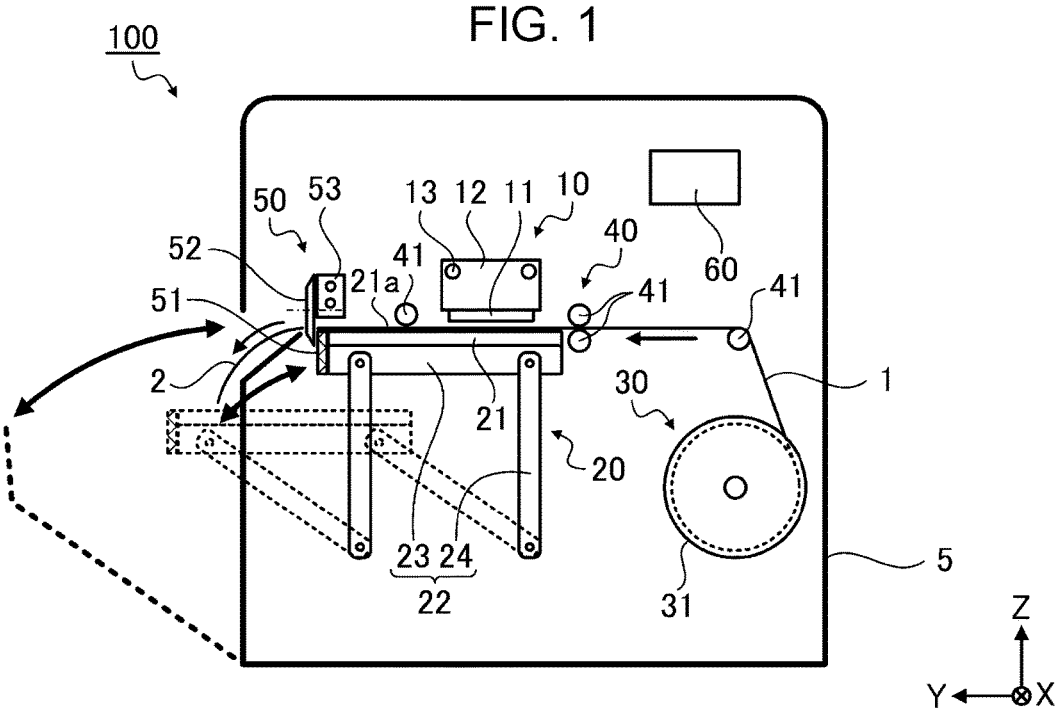
FIG. 1 is a configuration diagram of a printing apparatus according to Embodiment 1 viewed laterally.

Embodiments embodying the invention will be described with reference to the drawings. The following is an embodiment of the invention and does not limit the invention. In the following drawings, in order to make the description easier to understand, the drawings may be described on a scale different from the actual scale in some cases. In addition, in the coordinates attached to the drawing, the Z axis direction is a vertical direction, the +Z direction is an upper side direction, the Y axis direction is a front and rear direction, the +Y direction is a forward direction, the X axis direction is a horizontal direction, the +X direction is a left direction, and the X-Y plane is a horizontal plane. In addition, the intersecting direction preferably indicates a direction orthogonal.

Embodiment 1

Basic Configuration of Printing Apparatus

FIG. 1 is a configuration diagram of a printing apparatus 100 according to Embodiment 1 viewed laterally. It is conceptually described to make the configuration easy to understand.

The printing apparatus 100 is an ink jet type printer that performs printing by ejecting droplets (ink droplets) onto a roll paper 1 as a "medium" supplied in a roll state.

The printing apparatus 100 is provided with a printing portion 10, a support portion 20, a supply portion 30, a transport portion 40, a cutting portion 50, and a control portion 60, and is configured as a single apparatus by a housing 5.

The printing portion 10 is provided with an ejection head 11, a carriage 12, a carriage guide shaft 13, and a carriage motor (not shown).

The ejection head 11 has a plurality of nozzles (not shown) for ejecting printing ink as ink droplets. The ejection head 11 is mounted on the carriage 12 and reciprocates in the scanning direction along with the carriage 12 which is scanned and moved in the scanning direction (X axis direction in FIG. 1).

The carriage guide shaft 13 extends in the scanning direction and supports the carriage 12. The carriage 12 that is supported by the carriage guide shaft 13 can slide against the carriage guide shaft 13. The carriage motor serves as a driving source when reciprocating the carriage 12 along the carriage guide shaft 13.

The carriage guide shaft 13 and the carriage motor are supported by a frame body (not shown) constituting the housing 5.

The printing apparatus 100 forms (prints) a desired image on the roll paper 1 by repeating an operation of ejecting ink droplets from the ejection head 11 while moving the carriage 12 mounted the ejection head 11 along the carriage guide shaft 13 under the control of the control portion 60, and an operation (transport) of moving the roll paper 1 in a transport direction (+Y direction) intersecting in the scanning direction (X axis direction) in a region (printing region) where the ink droplets are ejected from the ejection head 11 and the roll paper 1 is printed. Since it can be said that the scanning direction (X axis direction) intersects with the transport direction, it may be represented as an intersecting direction.

The carriage guide shaft 13 extends to a region deviated from the printing region, and the carriage 12 (ejection head 11) can move outside the printing region. The region deviated from the printing region to the +X side is a "home position" in the invention. In the home position, for example, in a case where the printing is not performed, maintenance operations such as capping that covers the ejection head 11 with a cap is performed so as not to dry the ink of the ejection head 11, flushing that forcibly ejects ink from the ejection head 11 to eliminate nozzle clogging, and wiping that wipes the ink adhering to the surface of the ejection head 11, are performed.

For example, as an ink set containing a dark ink composition, the ink includes ink sets of four colors obtained by adding black (K) to ink sets of three colors of cyan (C), magenta (M), and yellow (Y). In addition, for example, the ink includes ink sets of eight colors obtained by adding ink sets of light cyan (Lc), light magenta (Lm), light yellow (Ly), light black (Lk), and the like, which contains light ink compositions in which the concentration of each color material is lightened.

As a method (ink jet method) of ejecting ink droplets, a piezo method is used as a preferable example. The piezo method is a method in which pressure corresponding to a print information signal is applied to ink stored in a pressure chamber by a piezoelectric element (piezo element), and ink droplets are ejected (discharged) from a nozzle communicating with the pressure chamber to perform printing.

The method of ejecting the ink droplets is not limited thereto, and other printing methods may be used in which the inks are ejected in a droplets to form a group of dots on the medium. For example, it may be a method in which ink is continuously ejected from a nozzle in a droplets with a strong electric field between accelerating electrodes placed in front of the liquid ejection nozzle (hereinafter referred to as a nozzle) and the nozzle and a printing information signal is transmitted from a deflecting electrode while the ink droplets are flying to perform printing, or a method (electrostatic suction method) of ejecting ink droplets corresponding to printing information signals without deflecting, a method of forcibly ejecting ink droplets by applying pressure to the ink with a small pump and mechanically vibrating the nozzle with a crystal vibrator or the like, and a method (thermal jet method) in which ink is heated and foamed by a microelectrode in accordance with print information signals and ink droplets are ejected to perform printing.

The supply portion 30 is provided with a roll paper accommodating portion 31 that rotatably holds the roll paper 1, and supplies the roll paper 1 accommodated in the roll paper accommodating portion 31 to the printing portion 10 in accordance with a driving of the transport portion 40.

The transport portion 40 is provided with a plurality of transport rollers 41 that transports the roll paper 1. The transport portion 40 transports the roll paper 1 from the supply portion 30 to the printing portion 10 and the cutting portion 50 by the rotation of the transport roller 41. In order to reduce load fluctuation to be applied to the transport portion 40 as much as possible, a tension lever (not shown) may be provided between the supply portion 30 and the transport portion 40, or the roll paper 1 may be slacked. The transport portion 40 transports the roll paper 1 in both the transport direction from the supply portion 30 to the printing portion 10 and the cutting portion 50, and in a reverse transport direction from the printing portion 10 and the cutting portion 50 toward the supply portion 30. When the transports in both directions are repeated, the roll paper 1 is likely to skew due to an assembly error of the transport roller 41.

The support portion 20 is provided with a platen 21 that supports the roll paper 1 transported in the transport direction in the printing region, and a platen support mechanism 22 that movably supports the platen 21.

The platen 21 has a medium support surface 21*a* that supports the roll paper 1. The medium support surface 21*a* may be provided with means (for example, adsorption means or pressing means) that brings the transported roll paper 1 into close contact. The platen support mechanism 22 has a support member 23 that supports the platen 21 and two pairs of turning legs 24 that movably supports the support member 23.

As shown in FIG. 1, among the two pairs of turning legs 24, the pair of turning legs 24 supports the platen 21 at both ends in the width direction (X axis direction) from the lower side (−Z side) via the support member 23 on the upstream side (−Y side) in the transport direction. Among the two pairs of turning legs 24, the other pair of turning legs 24 supports the platen 21 at both ends in the width direction (X axis direction) from the lower side (−Z side) via the support member 23 on the downstream side (+Y side) in the transport direction. The two pairs of the turning legs 24 pivot in parallel in the Y-Z plane with each lower ends as a fulcrum and move in parallel the support member 23 (that is, platen 21) in a pantograph manner. Rotation fulcrums (fulcrums of the lower end) of the two pairs of the turning legs 24 are fixed to the frame body constituting the housing 5.

At the time of printing, the platen support mechanism 22 is fixed at a position where the platen 21 faces the ejection head 11 (positional relationship between the frame body and the platen support mechanism 22 in this state corresponds to a "first position" in the invention). At this time, a nozzle plate (not shown) on which the nozzles are disposed and the medium support surface 21*a* are disposed at a predetermined distance. In addition, when the support member 23 is pulled out to the +Y side by the user, the turning leg 24 pivots and the platen 21 moves from a fixed position at the time of printing to a position on the forward side (+Y side) indicated by a broken line in FIG. 1 (positional relationship between the frame body and the platen support mechanism 22 in this state corresponds to a "second position" in the invention).

In this manner, as the platen 21 is moved, the user can easily perform a treatment in a case where the roll paper 1 is clogged (paper jam) and a maintenance work such as cleaning of the printing portion 10 or the platen 21 in the printing region. Thus, the platen unit (the support member 23, the platen 21, and the fixed blade 51) is movable to a first position where the platen 21 faces the printing portion 10 and/or a second position where the platen 21 is more separated from the printing portion 10 than in the first position. In the embodiment, although the platen 21 can be moved by the turning legs 24, any configuration may be employed as long as the user can move the platen 21 to a position separated from the ejection head 11. For example, the platen 21 may be movable in a predetermined direction within a horizontal plane (X-Y plane).

The control portion 60 is provided with a CPU (computation unit), a storage medium such as a RAM, a ROM (not shown), and controls the entire printing apparatus 100. Specifically, the control portion 60 controls the printing portion 10, the support portion 20, the supply portion 30, the transport portion 40, and the cutting portion 50 based on image data received from an external electronic device such as a personal computer or an external storage medium, forms a desired printed image on the roll paper 1, and creates a printed matter in a state of the cut paper 2.

Structure of Cutting Portion (Cutting Device)

The cutting portion 50 is a "cutting device" in the invention. The cutting portion 50 is provided downstream of the platen 21 in the transport direction. The cutting portion 50 cuts the roll paper 1 on which the printed image was formed on the downstream side of the platen 21 in the transport direction. The cut paper 2 which is the cut roll paper 1 is discharged from the printing apparatus 100 as a printed matter. The position where the roll paper 1 is cut by the cutting portion 50 corresponds to the print image formed on the roll paper 1.

Figure 2:
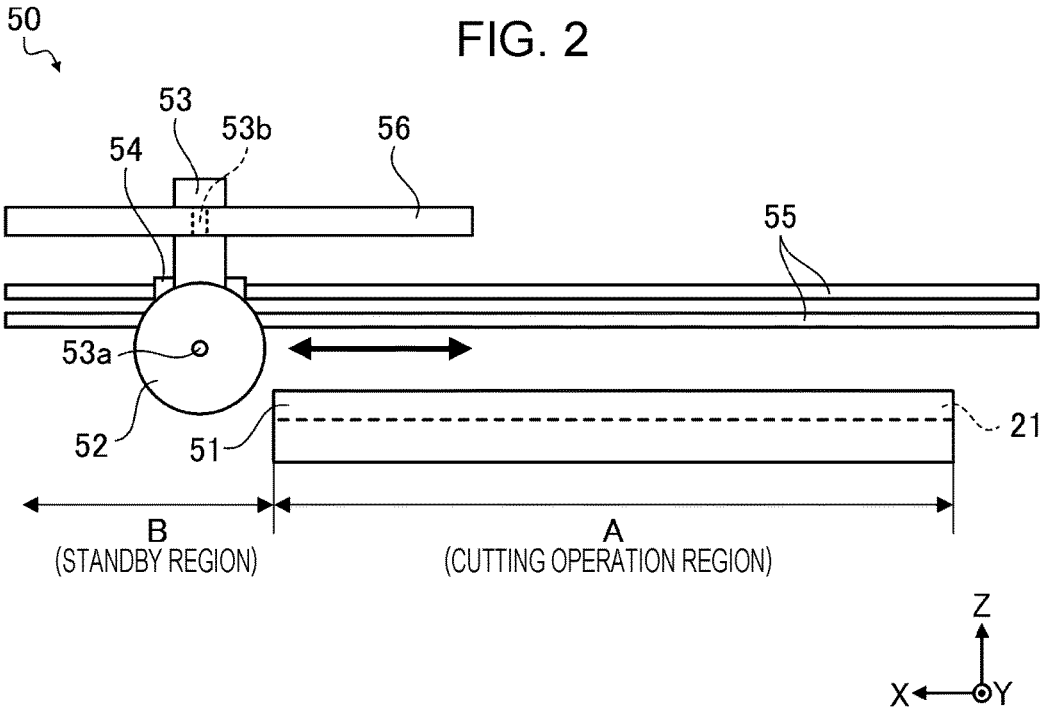
FIG. 2 is a schematic diagram showing a configuration of a cutting portion (cutting device).
Figure 3:
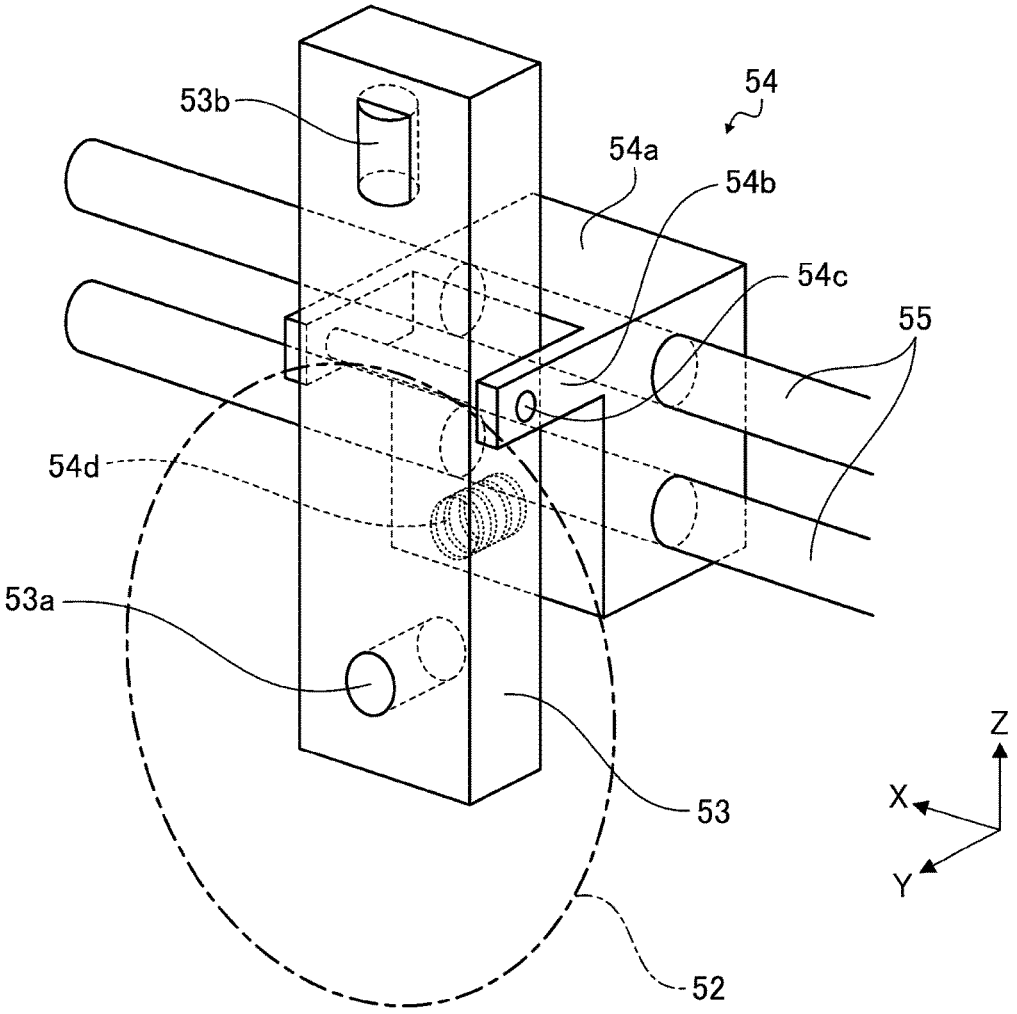
FIG. 3 is a perspective view showing a main portion of the cutting portion.

FIG. 2 is a schematic diagram showing a basic configuration of the cutting portion 50 and shows an aspect viewed from a front (+Y side). In addition, FIG. 3 is a perspective view showing a main portion of the cutting portion 50.

The cutting portion 50 has a fixed blade 51, a round blade 52, a round blade support portion 53, a round blade carriage 54, a round blade carriage guide shaft 55, a round blade guide 56, and a round blade carriage motor (not shown).

Figure 4:
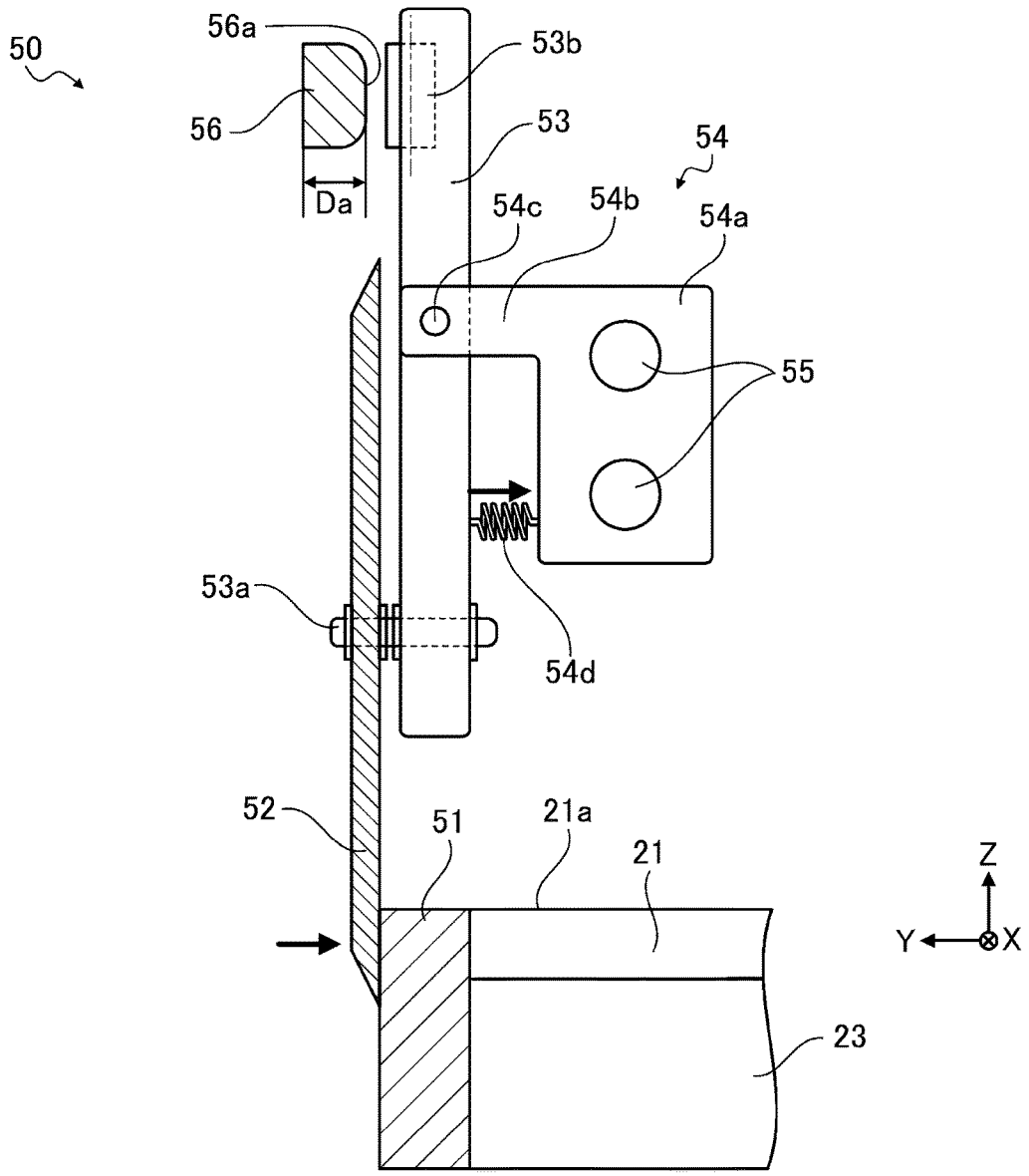
FIG. 4 is a side view of the main portion of the cutting portion.

The fixed blade 51 is a "first cutting member" in the invention. The fixed blade 51 extends in an intersecting direction (X axis direction) intersecting with the transport direction (Y axis direction) that transports the roll paper 1. More specifically, as shown in FIG. 1 and FIG. 4 to be described later, the fixed blade 51 is attached to the support member 23, and the upper surface (blade edge) of the fixed blade 51 attached to the support member 23 is positioned on an extension on the +Y side of the plane on which the medium support surface 21*a* of the platen 21 extends. The support member 23 supports the platen 21 and the fixed blade 51. A "platen unit" in the invention includes the support member 23, the platen 21, and the fixed blade 51.

The round blade 52 is a "second cutting member" in the invention and is a disk-shaped round blade which rotates and moves along the intersecting direction (X axis direction). The roll paper 1 is cut by the round blade 52 and the fixed blade 51 which rotate and move. The fixed blade 51 extends over only a portion of the range where the round blade 52 can move with respect to the intersecting direction (X axis direction). That is, in the region where the fixed blade 51 extends, when the round blade 52 moves along the intersecting direction (X axis direction) while abutting on the fixed blade 51, the roll paper 1 is cut.

As described above, the platen 21 of the application separates apart and brings close to the printing portion 10. At this time, the fixed blade 51 positioned on the same side as the platen 21 with respect to the transport path and positioned on the +Y side than the platen 21 moves together with the platen 21. When the platen 21 moves in this manner, the round blade 52 moves to a position (standby position to be described later) not facing the fixed blade so that the fixed blade 51 does not contact (face) the round blade 52.

The round blade support portion 53 is a support member which rotatably supports the round blade 52. The round blade 52 is rotatable about the rotation axis 53*a* included in the round blade support portion 53. The round blade support portion 53 is rotatably supported on the Y-Z plane in the round blade carriage 54. In addition, the round blade support portion 53 moves integrally with the round blade carriage 54 on the X axis. As will be described in detail later, the round blade support portion 53 is moved in the X direction along the shape of the round blade guide 56 (guide portion) abutting on the round blade support portion 53, so that the rotation of the round blade support portion 53 on the Y-Z plane is performed. The round blade support portion 53 is provided with a roller 53*b* at an abutting portion on the round blade guide 56.

As shown in FIG. 3, the round blade carriage 54 has a carriage base portion 54*a* which is in sliding contact with the round blade carriage guide shaft 55, a pair of support arms 54*b* protruding in the +Y direction from the carriage base portion 54*a*, a turning shaft 54*c* that supports the round blade support portion 53 so as to be rotatable in the Y-Z plane at the tip end portion of the support arm 54*b*, and a spring 54*d* that pulls the lower side of the round blade support portion 53 toward the round blade carriage 54 side with the turning shaft 54*c* as a fulcrum.

That is, the round blade carriage 54 rotatably supports the round blade support portion 53 (that is, supports the round blade 52 via the round blade support portion 53), and the round blade 52 supported by the round blade support portion 53 can be moved along the round blade carriage guide shaft 55. In addition, due to a pulling force of the spring 54*d*, the round blade 52 (blade edge of the round blade 52) is pressed against the fixed blade 51 (blade edge of the fixed blade 51) in the −Y direction from the +Y side.

As shown in FIG. 2, the round blade carriage guide shaft 55 extends in the X axis direction with a length greater than the width of the platen 21 (that is, extension length of the fixed blade 51) in the X axis direction and supports the round blade carriage 54. The round blade carriage 54 is in sliding contact with the round blade carriage guide shaft 55. In the example shown in the drawing, as a simple method of suppressing the rotation of the round blade carriage 54 on the Y-Z plane, although an example is shown in which two round blade carriage guide shafts 55 are provided, only one round blade carriage guide shaft 55 may be used as long as the configuration is such that the rotation of the round blade carriage 54 in the Y-Z plane can be suppressed.

The round blade carriage motor (not shown) is a drive source that reciprocates the round blade carriage 54 along the round blade carriage guide shaft 55. The mechanism that allows the round blade carriage 54 to reciprocate by the round blade carriage motor is for example, a mechanism configured to include a pair of pulleys and a belt suspended on the pulley and to which the round blade carriage 54 is connected, and which rotationally drives the pulley by the round blade carriage motor, a mechanism in which a ball or nut is used (for example, one of the round blade carriage guide shafts 55 is configured as a screw shaft), and a screw shaft is rotationally driven by a round blade carriage motor, and the like.

The round blade carriage guide shaft 55 and the round blade carriage motor are supported by the frame body described above (not shown). That is, the round blade carriage guide shaft 55, the round blade carriage 54, the round blade support portion 53, and the round blade 52 are supported by the frame body constituting the housing 5.

With such a configuration, in a region where the round blade 52 faces the fixed blade 51 (region A shown in FIG. 2 and region where the fixed blade 51 extends), the round blade 52 relatively moves in the X axis direction with respect to the fixed blade 51 in a state of abutting on the fixed blade 51, to cut the roll paper 1 interposed between the fixed blade 51 and the round blade 52.

In addition, the round blade carriage guide shaft 55 extends to a region on the +X side of the region A in the X direction as a region not facing the fixed blade 51 (region B outside the region A, refer to FIG. 2). The round blade carriage 54 which is in sliding contact with on the round blade carriage guide shaft 55 allows the round blade 52 to move from the region A facing the fixed blade 51 to the region B not facing the fixed blade 51. In the region B, since the fixed blade 51 does not extend, the round blade 52 does not face the fixed blade 51.

In the following description, the region A facing the fixed blade 51 is referred to as a cutting operation region A, and the region B where the fixed blade 51 deviated from the cutting operation region A on the +X side does not extend is referred to as a standby region B. In addition, the position where the round blade 52 stands by the start of cutting operation in the standby region B is referred to as a standby position.

When the roll paper 1 is transported in the transport direction and the reverse transport direction by the transport portion 40, the round blade 52 is positioned in the standby region B, so that it is possible to reduce the possibility that the roll paper 1 and the round blade 52 to be transported come into contact with each other except when cutting by the round blade 52. In addition, in order to perform the maintenance of the printing portion 10 and the like, when the user pulls the support member 23 forward (refer to FIG. 1), the round blade 52 is positioned in the standby region B. Therefore, not only the support member 23 is smoothly pulled out, but also the possibility that the round blade 52 is damaged by user's work is reduced, thereby allowing the user to perform maintenance work more easily.

In the standby region B, the round blade 52 is preferably in a state where the blade edge of the round blade 52 does not be in contact with any member. According to this configuration, when the round blade 52 is positioned in the standby region B, a possibility that the blade edge is deformed by an impact is reduced in a case where the impact is applied from the outside of the printing apparatus 100.

When cutting the roll paper 1, the round blade 52 moves from the standby position to the cutting operation region A. In this case, since the round blade 52 is biased by the pulling force of the spring 54*d* toward the fixed blade 51 side, when the round blade 52 abuts on the fixed blade 51, there is a possibility that the blade edge of the round blade 52 comes into contact (collides) with an edge end of the fixed blade 51 (end portion on the +X side). This is a cause of applying excessive load, impact, or damage to the round blade 52.

On the contrary, the round blade guide 56 acts so as to suppress the impact when the blade edge of the round blade 52 is in contact with the edge end of the fixed blade 51 (end portion on the +X side), and so as to suppress the impact of being in contact with the blade edge of the fixed blade 51. The round blade guide 56 is a "guide portion" in the invention.

This will be described in detail below.

FIG. 2 shows a front view of the round blade guide 56, FIGS. 4 and 5 to be described later show side sectional views, and FIG. 6 to be described later shows a plan view.

When the round blade 52 is positioned in the standby region B and a portion of the +X side of the cutting operation region A, the round blade guide 56 abuts on the roller 53*b* provided in the round blade support portion 53. The round blade support portion 53 is rotated by the contact between the roller 53*b* and the round blade guide 56, and by the rotation of the round blade support portion 53, the round blade 52 is separated in the Y axis direction from the position on the extension line in which the fixed blade 51 is virtually extended to the standby region B in the intersecting direction, or the position where the fixed blade 51 extends. In a case where the round blade 52 is positioned in the standby region B, the round blade guide 56 separates the fixed blade 51 in the +Y direction from the extension line virtually extended to the standby region B on the +X side, and when the round blade 52 moves from the standby region B to the cutting operation region A, guides the round blade support portion 53 so that the round blade 52 gradually approaches and abuts on the fixed blade 51. That is, when the round blade 52 enters a region facing the fixed blade 51 from a region not faced to the fixed blade 51, the round blade 52 is in a separation state of being separated from the fixed blade 51 in the transport direction. In other words, the separation state is a state in which the round blade 52 is separated from the fixed blade 51 in the first direction.

Thus, the round blade 52 can abut on, and/or separate from the fixed blade 51 while the round blade 52 moves along the round blade guide 56.

The round blade guide 56 is positioned above the turning shaft 54*c* on the forward side (+Y side) of the round blade support portion 53 so as to abut on the roller 53*b* (refer to FIG. 3) positioned above the turning shaft 54*c*, and is provided so as to extend in the standby region B and a portion of the region on the +X side of the cutting operation region A in the X axis direction. In addition, a curved surface is formed on an abutting surface 56*a* on the −Y side of the round blade guide 56 abutting on the roller 53*b*, and due to abutting between the curved surface and the roller 53*b*, the degree of rotation of the round blade support portion 53 (that is, degree of separating the round blade 52 from the position where the fixed blade 51 extends) can be changed (refer to FIG. 6).

Figure 5:
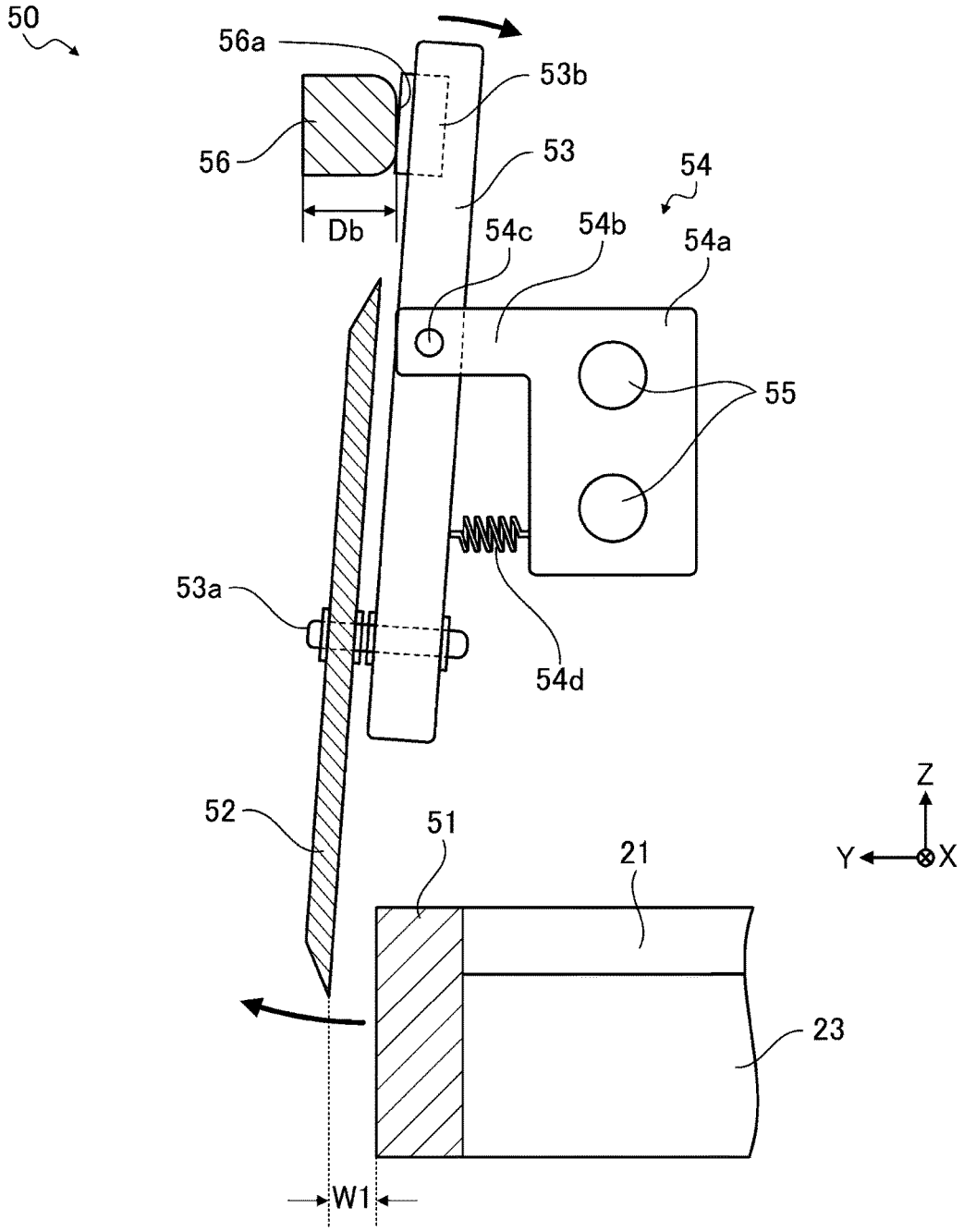
FIG. 5 is a side view of the main portion of the cutting portion.

FIGS. 4 and 5 are side views of main portions of the cutting portion 50 for describing the round blade guide 56 and the function thereof.

FIG. 4 shows an aspect in which the round blade 52 abuts on the fixed blade 51 in the cutting operation region A.

As described above, the round blade support portion 53 is rotatable about the turning shaft 54*c* that rotatably supports the round blade support portion 53 in the Y-Z plane as a fulcrum. In the cutting operation region A, the abutting surface 56*a* of the round blade guide 56 is positioned with a gap between the abutting surface 56*a* and the roller 53*b*. That is, when the round blade 52 is positioned in the cutting operation region A, the round blade support portion 53 is not rotated by the round blade guide 56, and the round blade 52 supported by the round blade support portion 53 abuts on the fixed blade 51 by the pulling force of the spring 54*d*.

In this state, the round blade 52 can be separated from the fixed blade 51 by pushing the upper portion of the round blade support portion 53 (portion above the turning shaft 54*c*) to the −Y side with a pressing force against the pulling force of the spring 54*d*.

The surface of the round blade 52 does not necessarily have to be on the X-Z plane as shown in FIG. 4, and in order to improve the sharpness against the roll paper 1, the blade edge of the round blade 52 may abut on the fixed blade 51 with an inclination.

FIG. 5 shows an aspect in which the round blade 52 is separated from the fixed blade 51 as viewed from the X axis direction in the standby region B. The standby region B is a portion of a range where the round blade 52 moves in the X axis direction and is a region where the fixed blade 51 does not extend, that is, a region where does not face the fixed blade 51.

In the standby region B, the abutting surface 56*a* of the round blade guide 56 abuts on the roller 53*b*. The round blade support portion 53 is pivoted due to this abutting, and the round blade 52 supported by the round blade support portion 53 is separated from the fixed blade 51 against the pulling force of the spring 54*d*.

Figure 6:
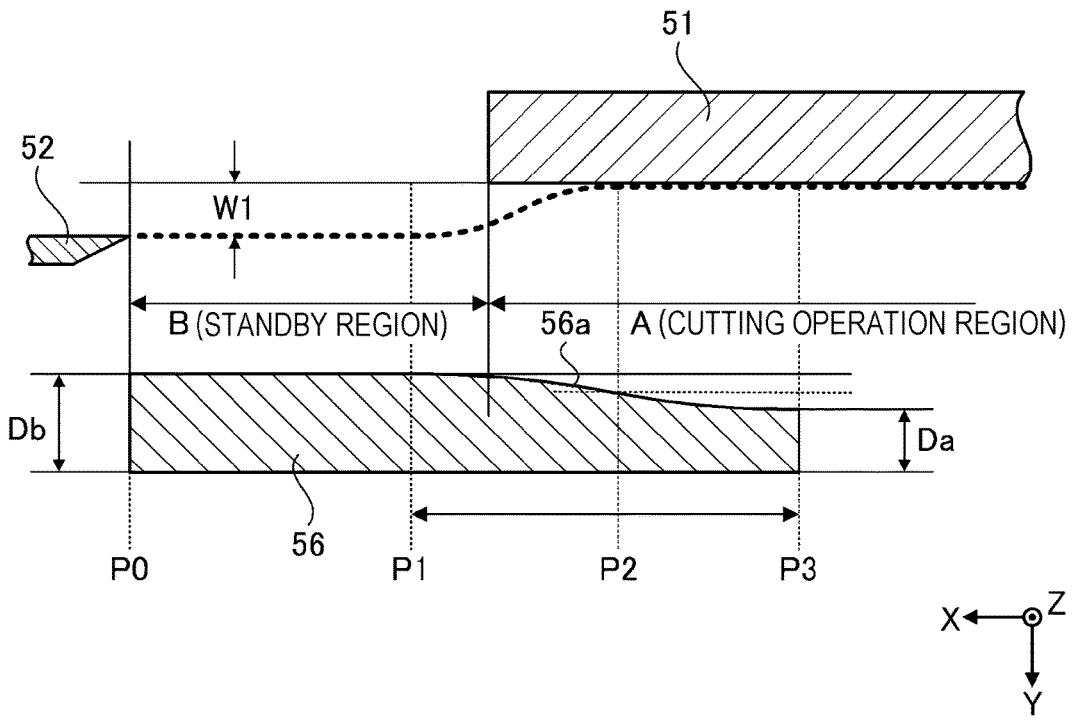
FIG. 6 is a plan view of a round blade guide.

FIG. 6 is a plan view showing a relationship between the planar shape of the round blade guide 56 and the length (separation length) at which the round blade 52 separates from the fixed blade 51.

A bold dashed line shown in FIG. 6 indicates the position of the blade edge of the round blade 52, which changes from a separation state of being separated from the fixed blade 51 to an abutting state of abutting on the fixed blade 51 as the round blade 52 moves from the standby region B to the cutting operation region A. In other words, the abutting state is a state in which the round blade 52 abuts on the fixed blade 51 in the first direction.

In a section of the standby region B from a standby position P0 to a standby position P1, the round blade guide 56 has a width Db in the Y axis direction, as shown in FIG. 5, the abutting surface 56*a* abuts on the roller 53*b*, the round blade support portion 53 is in a state of being rotated, and the round blade 52 is separated from the fixed blade 51 with a separation length W1. In the section of the standby region B from the standby position P0 to the standby position P1, the value of the separation length when the round blade 52 separates from the fixed blade 51 may not be W1. For example, the round blade 52 may be separated from the fixed blade 51 with any separation length W ($0<W<W1$) between the separation length W1 and 0 in contact therewith.

In addition, in the embodiment, in the section from the standby position P0 to the standby position P1, although the round blade 52 is separated from the fixed blade 51 with any separation length W, it may be not necessary to be separated with any separation length W in the entire region of the section. In other words, at least between the cutting operation region A and the standby region B, that is, when the round blade 52 enters a region facing the fixed blade 51 from a region not facing the fixed blade 51, the round blade 52 may be separated with any separation length W. For example, the round blade 52 positioned at a predetermined position in the standby region B may be in a state of being an abutting position abutting on the fixed blade 51 viewed from the X axis direction or a state of being displaced toward the fixed blade 51 side from the abutting position.

In the section from a standby position P1 in the standby region B to a position P3 in the cutting operation region A, the round blade guide 56 is shaped such that the abutting surface 56*a* is formed of a curved surface and the width in the Y axis direction gradually decreases from Db to Da. The surface on which the width in the Y axis direction gradually decreases from Db to Da may be a flat surface.

In this section, the width of the round blade guide 56 in the Y axis direction gradually decreases from Db to Da, so that as the round blade 52 moves from the standby region B to the cutting operation region A, the degree by which the roller 53*b* is pressed and the round blade support portion 53 is rotated gradually decreases and the separation length between the round blade 52 and the fixed blade 51 changes from the separation length W1 to 0 in contact therewith.

The position P2 in the cutting operation region A is a boundary position where the roller 53*b* does not abut on the abutting surface 56*a* of the round blade guide 56 as the round blade 52 moves from the standby region B to the cutting operation region A. When the round blade 52 abuts on the fixed blade 51 as the round blade 52 moves from the standby region B to the cutting operation region A, the rotation of the round blade support portion 53 is regulated by the fixed blade 51. In addition, the width in the Y axis direction of the round blade guide 56 gradually decreases from the position P2 to the −X side. As a result, the roller 53*b* separates from the abutting surface 56*a* of the round blade guide 56.

That is, as moving from the standby region B to the cutting operation region A, the round blade 52 changes by the round blade guide 56 in Y axis direction from the separation state of being separated with the separation length W1 at the standby position P1 to the abutting state abutting on the fixed blade 51 at the position P2 of the cutting operation region A. In other words, the round blade 52 is displaced with the movement in the X axis direction between the abutting position abutting on the fixed blade 51 as viewed from the X axis direction and the separated position separated from the abutting position in the Y axis direction. In addition, the round blade 52 is configured so as to be in a separated position in a region where the fixed blade 51 does not extend.

As described above, in the embodiment, although the standby region B where the round blade carriage 54 (round blade 52) stands by is provided in the region on the same side as the home position of the ejection head 11 (region deviated from the cutting operation region A toward the +X side), the standby region B may be provided in the region on the side opposite to the home position in the X direction (region deviated from the cutting operation region A toward the −X side). However, in that case, the home position of the ejection head 11 is preferably provided on the −X side of the printing region in the same manner. In addition, in this case, the round blade guide 56 needs to be provided on the −X side of the cutting operation region A with the orientation reversed in the X axis direction in the same manner.

As described above, according to the cutting device and the printing apparatus according to the embodiment, the following effects can be obtained.

According to the embodiment, when the round blade 52 moves and enters the region facing the fixed blade 51 from the region not facing the fixed blade 51, the round blade 52 is in the separation state of being separated from the fixed blade 51 in the transport direction. That is, when the round blade 52 moves to the region facing the fixed blade 51, the round blade 52 is prevented from colliding with the edge end portion of the fixed blade 51. As a result, abrasion and damage of the fixed blade 51 and the round blade 52 can be suppressed.

In addition, when the round blade 52 moves in the intersecting direction, the round blade 52 changes from the separation state to the abutting state abutting on the fixed blade 51 due to the sliding contact between the round blade guide 56 and the support portion 20. The change from the separation state of the round blade 52 to the abutting state is guided by the round blade guide 56, so that a collision when the round blade 52 abuts on the fixed blade 51 can be more reliably avoided.

In addition, the round blade 52 that cuts the roll paper 1 by relatively moving in the intersecting direction with respect to the fixed blade 51 is a disk-shaped round blade rotatably supported and cutting while rotating. Therefore, a scissors angle does not change unlike a push cutting type cutting device, and sharpness (cutting condition) hardly fluctuates with the movement of the round blade 52, so that cutting can be more stably performed.

In addition, in such a configuration, although the length of an outer circumference of the round blade 52 is shorter than an extension length of the fixed blade 51, and the life of the round blade 52 tends to be shorter than the life of the fixed blade 51, the impact (impact such as collision of the round blade 52 against the fixed blade 51) can be alleviated when the round blade 52 moves to the cutting operation region A and abuts on the fixed blade 51, so that the life of the round blade 52 can be further elongated.

In addition, since the printing apparatus 100 is provided with the cutting portion 50, the roll paper 1 can be cut at a desired position.

In addition, since the cutting portion 50 can retract the round blade 52 to the standby region B deviated from the cutting operation region A facing the fixed blade 51, even in a case where the roll paper 1 is skewed by the transport before and after printing, the roll paper 1 can be smoothly moved without colliding with the round blade 52.

In addition, even in a case where the operation of the round blade 52 moving between the cutting operation region A and the standby region B is repeated before and after cutting, since the impact when the round blade 52 abuts on the fixed blade 51 is alleviated, the frequency with which the round blade 52 is damaged is further reduced, and the printing apparatus 100 can be more stably operated.

In addition, since the fixed blade 51 and the platen 21 can be separated from the round blade 52 and the printing portion 10, a maintenance work can be more easily performed such as a case where the roll paper 1 is clogged (paper jam) in the printing region.

In addition, since the round blade 52 can move to the standby region B deviated from the cutting operation region A facing the fixed blade 51, by moving the round blade 52 to the standby region B when separating the platen 21 from the printing portion 10, it is easy to ensure a maintenance work space.

In addition, since the round blade 52 can be moved to the standby region B deviated from the region facing the fixed blade 51, it is easy to design a mechanism that separates and brings the platen 21 and the printing portion 10 apart and close to each other.

In addition, since the home position where the carriage 12 moves and the standby region B where the round blade 52 moves are provided on the same side as each other, the printing apparatus 100 can be configured more compactly.

The invention is not limited to the above-described embodiments, and various modifications and improvements can be added to the above-described embodiments. A modification examples will be described below. Here, the same reference numerals are used for the same constituent parts as those in the above-described embodiment, and redundant explanations are omitted.

Modification Example 1

Figure 7:
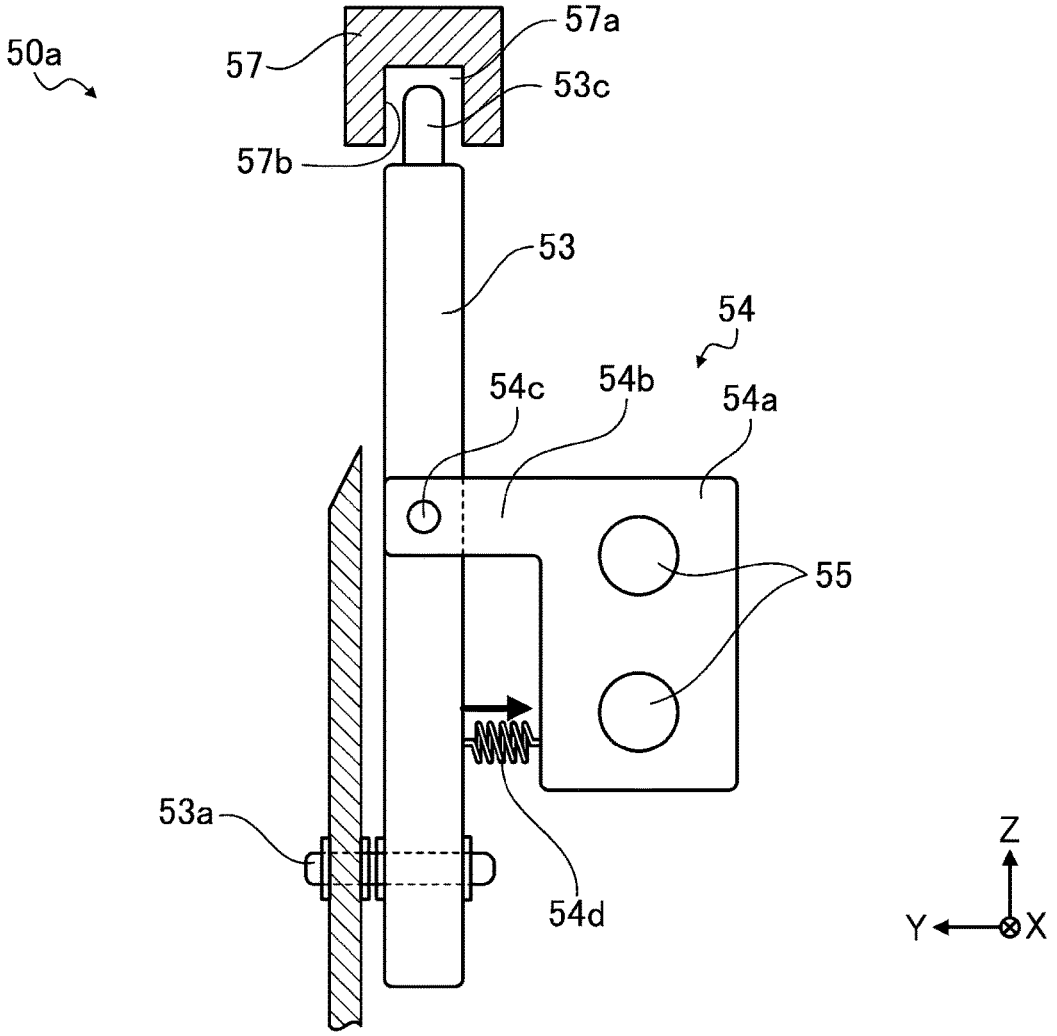
FIG. 7 is a side view of a main portion of a cutting portion according to Modification Example 1.

FIG. 7 is a side view of a main portion of a cutting portion 50*a* according to Modification Example 1.

In Embodiment 1, as shown in FIGS. 4 and 5, the round blade support portion 53 is provided with the roller 53*b* at the abutting portion on the round blade guide 56, and the rotation of the round blade support portion 53 on the Y-Z plane has been described as being performed along the shape of the round blade guide 56 that abuts on the roller 53*b*, but the invention is not limited this configuration.

The round blade support portion 53 provided in the cutting portion 50*a* has a protruding rod 53*c* protruding from the head thereof (uppermost portion of the round blade support portion 53) instead of the roller 53*b*.

In addition, the cutting portion 50*a* has a rail 57 instead of the round blade guide 56 as a "guide portion". Except for these points, the cutting portion 50*a* is the same as the cutting portion 50.

The position and length of the X axis direction of a rail 57 extend in the same manner as the round blade guide 56 (refer to FIGS. 2 and 6), and the rail 57 has a groove 57*a* that guides the position of the protruding rod 53*c* in the Y axis direction when the round blade 52 moves from the standby region B to the cutting operation region A.

The groove 57*a* opens on a lower side (−Z direction) of the rail 57 so that the protruding rod 53*c* is loosely inserted, and an inner wall 57*b* of the groove 57*a* on +Y side abuts on a side surface of the protruding rod 53*c* on +Y side. The groove 57*a* is configured to pivot the round blade support portion 53 as the round blade carriage 54 (round blade 52) moves from the standby region B to the cutting operation region A. That is, the inner wall 57*b* is formed so as to exhibit the same action as the abutting surface 56*a* of the round blade guide 56 abuts on the roller 53*b* and acts on the round blade support portion 53.

Even with such a configuration, the same effect as in Embodiment 1 can be obtained.

The "guide portion" is not limited to the round blade guide 56 having the abutting surface 56*a* that guides the rotation of the round blade support portion 53 in accordance with the movement of the round blade carriage 54 (round blade 52) from the standby region B to the cutting operation region A, and the rail 57 having the inner wall 57*b*, and, for example, may be configured to guide (or control) the rotation of the round blade support portion 53 by a cam that rotates in accordance with the relative movement of the round blade carriage 54 and the round blade carriage guide shaft 55. In addition, any shape may be used as long as the separation length between the round blade 52 and the fixed blade 51 gradually decreases. For example, by bending a plate material or the like having a certain thickness to form an abutting surface that guides a displacement (change in state position) of the round blade 52 and causing the roller 53*b* to follow, a shape in which the separation length between the round blade 52 and the fixed blade 51 gradually decreases may be used.

In addition, as means that biases the round blade 52 toward the fixed blade 51 side in the cutting operation region A, although it is described by using a spring 54*d* that pulls the lower side of the turning shaft 54*c* of the round blade support portion 53 in a direction of the round blade carriage 54, it is not limited thereto.

For example, a spring that presses the upper side of the turning shaft 54*c* of the round blade support portion 53 in a direction separating from the round blade carriage 54 may be used.

In addition, although it is described that the platen 21 supported by the support member 23 and the fixed blade 51 can be separated from the printing portion 10 supported by a frame body constituting the housing 5 and the round blade 52 by two pair of turning legs 24 movably supporting the support member 23, the configuration for separating these from each other is not limited to thereto.

For example, the platen 21 and the fixed blade 51 may be supported by the frame body constituting the housing 5, and the support portion supporting the printing portion 10 and the round blade 52 (specifically, round blade carriage guide shaft 55 and round blade guide 56) may be configured to be movable upward.

In addition, for example, the fixed blade 51 may be configured to be supported by the frame body together with the printing portion 10 instead of the support member 23, and the round blade 52 (specifically, round blade carriage guide shaft 55 and round blade guide 56) may be configured to be supported by the support member 23 together with the platen 21. In this case, the "platen unit" in the invention has a configuration to include the support member 23, the platen 21, and the round blade 52 (specifically, round blade carriage guide shaft 55 and round blade guide 56).

This application claims priority under 35 U.S.C. § 119 to Japanese Patent Application No. 2017-084207, filed Apr. 212017. The entire disclosure of Japanese Patent Application No. 2017-084207 is hereby incorporated herein by reference.

What is claimed is:

1. A cutting device comprising:

a first cutting member that extends in an intersecting direction intersected with a transport direction transporting a medium;

a second cutting member that cuts the medium by relatively moving in the intersecting direction with respect to the first cutting member in a state of being abutted on the first cutting member; and a support portion that supports the second cutting member, wherein the first cutting member extends over a portion of a range where the second cutting member relatively moves, and the support portion is configured to be rotated such that the second cutting member is in a separation state of being separated from the first cutting member in the transport direction when entering a region facing the first cutting member from a region not facing the first cutting member.

2. The cutting device according to claim 1, further comprising:

a guide portion that guides the second cutting member in accordance with a movement from the region not facing the first cutting member to the region facing the first cutting member, wherein the second cutting member is changed from the separation state to an abutting state of abutting on the first cutting member by sliding contact between the guide portion and the support portion when the second cutting member moves in the intersecting direction.

3. The cutting device according to claim 1, wherein the second cutting member is a rotatably supported disk-shaped round blade.

4. A printing apparatus comprising:

a transport portion that transports a medium in a transport direction;

a printing portion that performs printing on the medium to be transported;

a platen that supports the medium in a printing region where the printing is performed;

a first cutting member that extends in an intersecting direction intersected with the transport direction;

a second cutting member that cuts the medium by relatively moving in the intersecting direction with respect to the first cutting member in a state of being abutted on the first cutting member; and a support portion that supports the second cutting member, wherein the first cutting member extends over a portion of a range where the second cutting member relatively moves, and the support portion is configured to be rotated such that the second cutting member is in a separation state of being separated from the first cutting member in the transport direction when entering a region facing the first cutting member from a region not facing the first cutting member.

5. The printing apparatus according to claim 4, further comprising:

a platen unit that includes the first cutting member or the second cutting member and the platen, wherein the platen unit is movable to a first position where the platen faces the printing portion and a second position where the platen is more separated from the printing portion than in the first position.

6. The printing apparatus according to claim 4, wherein the printing portion includes an ejection head that moves to a home position deviated from the printing region, and a region where the second cutting member does not face the first cutting member is provided on the same side as the home position in the intersecting direction.

* * * * *